US010203120B2

(12) United States Patent
Hofmann et al.

(10) Patent No.: US 10,203,120 B2
(45) Date of Patent: Feb. 12, 2019

(54) INSULATION FOR BAKING OVENS

(71) Applicant: Electrolux Appliances Aktiebolag, Stockholm (SE)

(72) Inventors: Arnd Hofmann, Rothenburg ob der Tauber (DE); Fabienne Reinhard-Herrscher, Rothenburg ob der Tauber (DE)

(73) Assignee: Electrolux Appliances Aktiebolag, Stockholm (SE)

( * ) Notice: Subject to any disclaimer, the term of this patent is extended or adjusted under 35 U.S.C. 154(b) by 256 days.

(21) Appl. No.: 14/915,393

(22) PCT Filed: Oct. 31, 2014

(86) PCT No.: PCT/EP2014/073482
§ 371 (c)(1),
(2) Date: Feb. 29, 2016

(87) PCT Pub. No.: WO2015/063276
PCT Pub. Date: May 7, 2015

(65) Prior Publication Data

US 2016/0223207 A1 Aug. 4, 2016

(30) Foreign Application Priority Data

Oct. 31, 2013 (EP) ..... 13191069

(51) Int. Cl.
*F24C 15/34* (2006.01)
*F24C 3/00* (2006.01)
*F27B 14/02* (2006.01)

(52) U.S. Cl.
CPC ..... *F24C 15/34* (2013.01); *F24C 3/00* (2013.01); *F27B 14/02* (2013.01)

(58) Field of Classification Search
CPC ..... F24C 15/34; F24C 3/00; F27B 14/02
USPC ..... 126/273.5, 21
See application file for complete search history.

(56) References Cited

U.S. PATENT DOCUMENTS 3,422,809 A 1/1969 Perry
3,916,872 A * 11/1975 Kreis ..... A47J 36/2494 126/246
3,923,674 A * 12/1975 Shannon ..... C04B 28/18 106/14.21

(Continued)

OTHER PUBLICATIONS

International Search Report issued in PCT/EP2014/073482 dated Feb. 5, 2015, 2 pages.

*Primary Examiner* — Gregory Huson
*Assistant Examiner* — Nikhil Mashruwala
(74) *Attorney, Agent, or Firm* — Pearne & Gordon LLP

(57) ABSTRACT

Baking oven insulation including at least a first insulating layer composed of a fiber material, and a metallic sheet material layer and a second insulating layer at least partially composed of a fiber material. The first and second insulating layers are located at opposite sides of the metallic sheet material layer. The first insulating layer is an inner layer to be arranged immediately at the outer side of a cavity wall of a baking oven and immediately at the inner side of the metallic sheet material layer. Moreover, the second insulating layer is an outer layer adapted to be spaced from the cavity wall of the baking oven. The first insulating layer has a thickness d1 which enables the first insulating layer to reduce the heat conduction from the cavity wall to the metallic sheet layer.

20 Claims, 2 Drawing Sheets

(56) References Cited

U.S. PATENT DOCUMENTS

| | | | | |
|---|---|---|---|---|
| 4,336,443 | A * | 6/1982 | Benedetto | F27D 11/02 126/21 A |
| 4,556,202 | A | 12/1985 | Yamura et al. | |
| 4,854,298 | A * | 8/1989 | Craver | F24B 1/026 110/211 |
| 6,758,206 | B1 * | 7/2004 | Barnes | F24C 15/006 126/15 R |
| 6,951,214 | B2 * | 10/2005 | Beech | A21B 1/04 126/1 F |
| 7,252,868 | B2 * | 8/2007 | Suda | B32B 5/24 428/74 |
| 9,487,953 | B2 * | 11/2016 | Nagarajan | E04C 2/02 |
| 9,513,017 | B2 * | 12/2016 | Choudhary | F24C 15/34 |
| 2008/0246379 | A1 | 10/2008 | Choudhary et al. | |
| 2014/0322477 | A1 * | 10/2014 | Jeon | F24B 1/24 428/76 |

* cited by examiner

INSULATION FOR BAKING OVENS

The present invention relates generally to the field of baking ovens. More specifically, the present invention is related to an insulation for a baking oven which reduces the energy loss of the baking oven.

BACKGROUND OF THE INVENTION

Baking ovens for preparing food are well known in prior art. Recent trends in developing baking ovens tend to reduce the energy consumption. There are different starting points for reducing the energy consumption of a baking oven, e.g. enhancing the thermal insulation of the oven cavity, using the residual heat of the heating elements etc.

The thermal insulation of the oven cavity is obtained by encapsulating the outer side of the cavity wall using a baking oven insulation yielding to a reduced thermal radiation. Thereby the thermal losses are reduced and a thermal protection of objects surrounding the baking oven, e.g. cabinets, is achieved.

German utility patent DE 81 21 032 U1 discloses a thermal insulation for baking ovens. The baking oven insulation comprises a reflecting foil building the inner layer adjacent to a cavity wall, a mat of heat resisting material and a gauze forming the outer side of the baking oven insulation.

A drawback of the known baking oven insulation is that referring to an insulation with a predetermined thickness, the energy losses are still relatively high. In addition, the energy losses of the baking oven are increased due to spacings between the cavity wall and the baking oven insulation allowing convective heat flow between the cavity wall and the baking oven insulation.

SUMMARY OF THE INVENTION

It is an objective of embodiments of the invention to provide for an effective baking oven insulation which provides an optimized thermal barrier thereby reducing the outwardly oriented heat radiation of the baking oven. The objective is solved by the features of the independent claims. Preferred embodiments are given in the dependent claims. If not explicitly indicated otherwise, embodiments of the invention can be freely combined with each other.

According to a first aspect of the invention, the baking oven insulation comprises at least a first insulating layer composed of a fibre material, a metallic sheet material layer and a second insulating layer at least partially composed of a fibre material, wherein the first and second insulating layers are located at opposite sides of the metallic sheet material layer, wherein the first insulating layer is an inner layer to be arranged immediately at the outer side of a cavity wall of a baking oven and immediately at the inner side of the metallic sheet material layer, and the second insulating layer is an outer layer adapted to be spaced from the cavity wall of the baking oven wherein the first insulating layer comprises a thickness $d_1$ which enables the metallic sheet material layer to efficiently reflect the thermal radiation from the cavity wall, in particular which enables the metallic sheet material layer to efficiently reflect the thermal radiation from the cavity wall in a relatively high degree, and which enables the first insulating layer to reduce the heat conduction from the cavity wall to the metallic sheet layer, in particular to reduce the heat conduction from the cavity wall to the metallic sheet layer as compared to a metallic sheet layer that is arranged without any intermediate insulating layer at a few millimetres from the cavity wall. Thus, an insulation is provided which overall needs only a small available space on the appliance on which it is built in and which is highly efficient. The applicant has surprisingly observed, that a smaller thickness of the inner layer can advantageously shorten considerably the heat up phase of the baking oven.

The main advantage of the baking oven insulation is the high flexibility which allows an optimal adaption of the insulation to the cavity wall of the baking oven. Thereby, the formation of spacings between the cavity wall and the baking oven insulation is prohibited which would lead to high thermal losses due to thermal convection. In addition, the applicant found out that distancing a metallic sheet material layer forming a reflective barrier from the cavity wall enhances the reflection of thermal radiation thereby increasing the thermal insulating effect.

Preferably, the insulation material of the first insulating layer and the thickness of the first insulating layer are chosen such that said first insulating layer ensures that the metallic sheet material is arranged in a close distance from the cavity wall, for example, in a distance between 0.5 cm and 1.5 cm, preferably lower than 1 cm in order to enhance the heat reflecting effect of the metallic sheet material. Specifically, the thickness of the first insulating layer is lower than the thickness of the second insulating layer and the specific material density of the first insulating layer is lower than the specific material density of the second insulating layer. Thereby, the heating-up phase of an oven including said oven insulation can be significantly reduced because the low specific material density of the first insulating layer and the reflective effect of the metallic sheet material layer effectively reduce the loss of heat during the heat up phase.

According to a second aspect of the invention, the invention relates to a baking oven insulation comprising at least a first insulating layer composed of a fibre material, a metallic sheet material layer and a second insulating layer at least partially composed of a fibre material. The fibre material may be a flexible, wool-like material. Said first and second insulating layers are located at opposite sides of the metallic sheet material layer. Aforesaid layers may abut directly to each other without any gaps or spacings and form a mat-like baking oven insulation to be placed around the cavity of the baking oven. The first insulating layer is an inner layer to be arranged immediately at the outer side of a cavity wall of a baking oven and the second insulating layer is an outer layer adapted to be spaced from the cavity wall of the baking oven and wherein the fibre material of the first insulating layer is made of glass wool with a material density between 20-50 kg/m$^3$, preferably between 30-40 kg/m$^3$, most preferably 35 kg/m$^3$, or rock wool with a material density between 40-60 kg/m$^3$, preferably 45 kg/m$^3$.

The second insulating layer ensures with its thickness and specific material density the functionality of common single layer oven insulation. The heat radiated by the cavity wall and transmitted through the metallic sheet material is retained by the second insulating layer due to its higher specific material density. In addition, the higher specific material density of the second insulating layer ensures a higher mechanical stability during the assembly process.

According to further embodiments, the second insulating layer is formed by a stack of insulating sub-layers comprising at least two sub-layers. Thereby, the insulating effect of the second insulating layer can be adapted to the specific situation. Specifically, the insulation capacity of the baking oven insulation during heating-up the oven and the insulation capacity of the baking oven insulation after finishing heating-up phase can be chosen properly.

According to a third aspect of the invention, the baking oven insulation comprises at least a first insulating layer composed of a fibre material, a metallic sheet material layer and a second insulating layer at least partially composed of a fibre material, wherein the first and second insulating layers are located at opposite sides of the metallic sheet material layer, wherein the first insulating layer is an inner layer to be arranged immediately at the outer side of a cavity wall of a baking oven and the second insulating layer is an outer layer adapted to be spaced from the cavity wall of the baking oven and wherein the second insulating layer is formed by a stack of insulating sub-layers comprising at least two sub-layers. Said sub-layers may be made of different materials comprising different insulation properties. Advantageously, the baking oven insulation is highly flexible which allows an optimal adaption of the insulation to the cavity wall of the baking oven. In addition, by choosing suitable materials for the first and second insulation sub-layer, the insulation capacity of the baking oven insulation during heating-up the oven and the insulation capacity of the baking oven insulation after finishing heating-up phase, i.e. during continuous heating, can be chosen properly.

According to further embodiments, the fibre material of the first insulating layer is made of glass wool with a material density between 20-50 kg/m$^3$, preferably between 30-40 kg/m$^3$, most preferably 35 kg/m$^3$, or rock wool with a material density between 40-60 kg/m$^3$, preferably 45 kg/m$^3$. Said fibre material is advantageous because a highly flexible insulation with improved insulation properties is achieved.

According to further embodiments, the metallic sheet material layer is formed by a metallic foil, preferably by an aluminium foil. Thereby, the flexibility of the baking oven insulation is enhanced.

According to further embodiments, the first and second insulating layers immediately lie against the metallic sheet material layer with their whole lateral face. Thereby, the baking oven insulation forms a mat with immediately adjacent layers without any spacings or gaps. Thereby the thermal insulation effect of the baking oven insulation is further increased.

According to further embodiments, the first insulating layer comprises a first thickness d1 and the second insulating layer comprises a second thickness d2, wherein the first thickness d1 is smaller than the second thickness d2. Preferably, the first insulating layer comprises a thickness d1 and the second insulating layer comprises a thickness d2, wherein the ratio d1/d2 is in the range between 0.25 and 3, preferably in the range between 0.25 and 0.75 and most preferably in the range between 0.25 and 0.5. Experiments of the applicant have shown that upper-mentioned thickness ratios lead to an enhanced insulation effect in comparison to thickness ratios outside of said ranges.

According to further embodiments, the first insulating layer comprises a thickness d1 in the range of 0.5 cm to 1.5 cm and the second insulating layer comprises a thickness d2 in the range of 1 cm to 2.5 cm, preferably 1.3 cm to 1.8 cm. Thereby, a baking oven insulation with low height (e.g. a height smaller than 3 cm) is achieved.

According to further embodiments, the first and second insulating layer comprises the same or different fibre material. Preferably, the first insulating layer is formed by a material with higher heat resistance than the second insulating layer because the heat applied to the second insulating layer is lower than the heat applied to the first insulating layer. The first insulating layer may be formed by stone wool and the second insulating layer may be formed by glass wool.

According to further embodiments, the second insulating layer comprises a fibre material with greater material density than the first insulating layer. By using a second insulating layer with greater material density, the insulation properties of the baking oven insulation during continuous heating of the oven cavity are enhanced.

According to further embodiments, the fibre material of the first and second insulating layer comprises a coefficient of thermal conductivity in the range of 0.030-0.045 W/mK and/or a specific heat capacity in the range of 840-1000 J/kgK. Thereby, effective heat insulation with a relative low thickness of the baking oven insulation may be achieved. In addition, specific heat capacity of the baking oven insulation is reduced leading to a reduced thermal loss due to heating up and cooling down of the baking oven insulation.

According to further embodiments, the second insulating layer comprises a fibre material with higher heat capacity than the first insulating layer. Thereby, the insulation properties of the baking oven insulation during continuous heating of the oven cavity are further enhanced.

According to further embodiments, the first and second insulating layers are arranged in parallel or substantially in parallel to one another.

According to further embodiments, the insulating sub-layers are woven together in order to build an integrally formed layer. Thereby, the linkage between the first and second sub-layers is significantly increased.

According to further embodiments, the material density of a second insulating sub-layer being spaced from the metallic sheet material layer by means of the first insulating sub-layer is at least 10% higher than the material density of the first insulating sub-layer. Thereby, the insulation properties of the baking oven insulation during continuous heating of the oven cavity are further enhanced.

According to further embodiments, the second insulating layer is formed by a stack of insulating sub-layers comprising at least three sub-layers. Thereby, a stack-like second insulating layer is obtained with different sub-layers, wherein the sub-layers may differ in their material density and their material. Thus, a baking oven insulation with enhanced insulation properties may be obtained.

According to further embodiments, a first sub-layer arranged in direct proximity to the metallic sheet material layer and a third sub-layer being spaced from the first sub-layer by a second sub-layer are composed of a fibre material. Thereby, the flexibility of the baking oven insulation is maintained. Furthermore, especially the outer side of the baking oven insulation being arranged in proximity to the housing is flexible, thereby allowing an adaption to the surface of said housing.

According to further embodiments, a second sub-layer arranged between a first sub-layer and a third sub-layer is formed by a rigid insulation material, preferably by micro-porous silica or foam glass. The micro-porous silica or foam glass may be at least partially made of recycled materials. Said materials show a low coefficient of thermal conductivity thereby enhancing the heat insulation of the baking oven.

According to a further aspect, the invention relates to a baking oven comprising an oven cavity with a cavity wall, wherein the cavity wall is at least partially covered by a baking oven insulation according to anyone of the preceding claims.

BRIEF DESCRIPTION OF THE DRAWINGS

The various aspects of the invention, including its particular features and advantages, will be readily understood from the following detailed description and the accompanying drawing, in which.

DETAILED DESCRIPTION OF PREFERRED EMBODIMENTS

Figure 1:
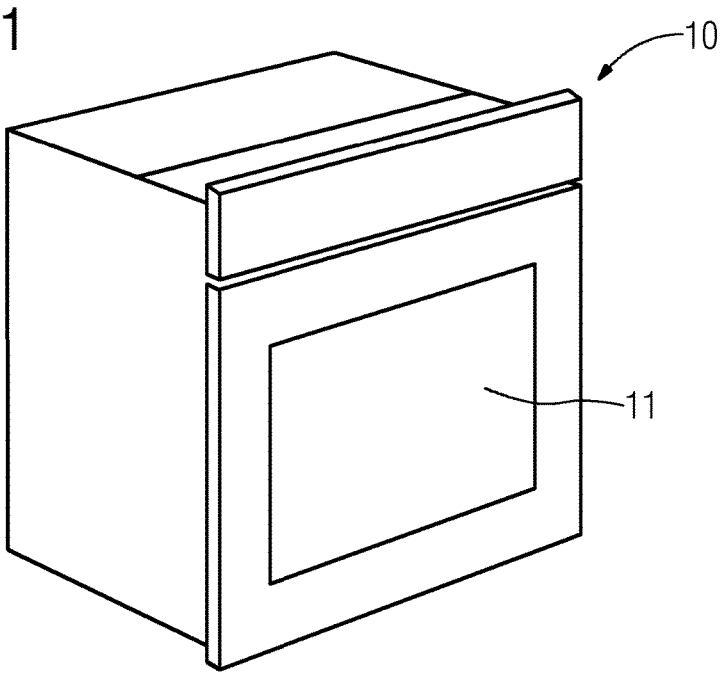
FIG. 1 shows a schematic diagram of a baking oven according to the invention.

The present invention will now be described more fully with reference to the accompanying drawings, in which example embodiments are shown. However, this invention should not be construed as limited to the embodiments set forth herein. Throughout the following description similar reference numerals have been used to denote similar elements, parts, items or features, when applicable.

FIG. 1 illustrates a baking oven 10. The baking oven 10 comprises an oven cavity 11 which is adapted to receive the food to be cooked and/or baked. The baking oven 10 may comprise at least one heating element for heating the interior of the oven cavity 11. Thereby, the temperature inside the oven cavity 11 is raised to a temperature significantly higher than the ambient temperature of the baking oven 10.

In order to keep thermal losses as low as possible and to protect the surrounding area of the baking oven, particularly when the oven is integrated in a furniture niche or cabinet, the cavity 11 of the baking oven 10 is encapsulated by a thermal baking oven insulation 1.

Figure 2:
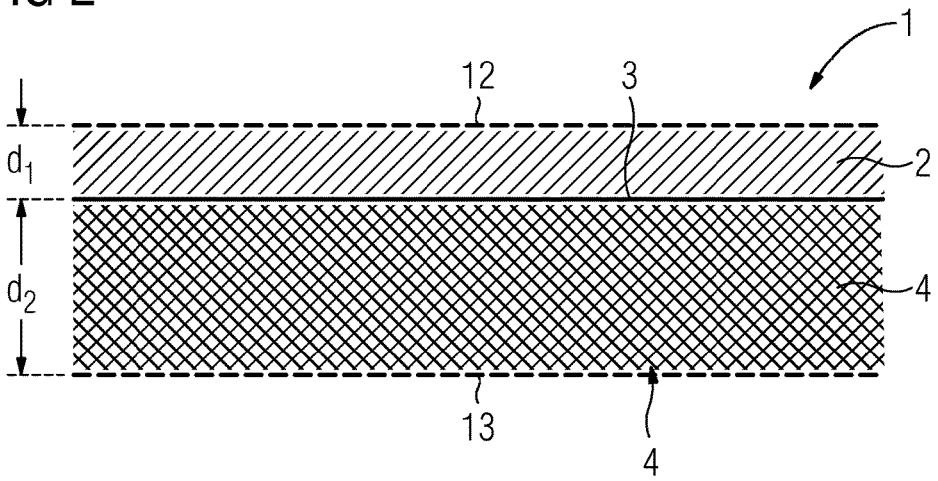
FIG. 2 shows a schematic diagram of a baking oven insulation according to a first embodiment of the invention.

FIG. 2 shows a first embodiment of a baking oven insulation 1. The baking oven insulation 1 may be arranged in close proximity to the outer side of a cavity wall 12 confining the oven cavity 11. Preferably, the baking oven insulation 1 may be arranged immediately at the outer side of the cavity wall 12. Furthermore, the baking oven insulation 1 may be arranged between the cavity wall 12 and a housing 13, which builds the chassis of the baking oven 10.

The baking oven insulation 1 may be a flexible insulation constituted by a stack of multiple layers, wherein adjacent layers abut against each other without any gaps or spacings between said layers. Specifically, the baking oven insulation 1 comprises a first insulating layer 2 which immediately adjoins to a metallic sheet material layer 3. The metallic sheet material layer 3 adjoins at the side opposite to the first insulating layer 2 to a second insulating layer 4. Preferably, the metallic sheet material layer 3 adjoins immediately at the side opposite to the first insulating layer 2 to a second insulating layer 4. The first insulating layer 2 forms an inner layer immediately adjacent to the outer side of the cavity wall 12 of the oven cavity 11 effecting a spacing between the cavity wall 12 and the metallic sheet material layer 3.

The metallic sheet material layer 3 acts as an efficient reflector for heat radiation escaping from the oven cavity 11 through the cavity wall 12. In other words, the metallic sheet material layer 3 forms a reflective barrier for heat radiation exhausting through the cavity wall 12. The metallic sheet material layer 3 may be formed by a metallic foil, e.g. an aluminium foil. The second insulating layer 4 forms an outer insulating layer which may be located adjacent to the housing 13 of the baking oven 10. For example, the first and second insulating layers 2, 4 may be adhered immediately to the metallic sheet material layer 3.

The first and second insulating layers 2, 4 may be formed by a fibre material, specifically by a mineral fibre material. Preferably, the fibre material is glass wool or stone wool. Furthermore, the fibre material of the first and second insulating layers 2, 4 may comprise a coefficient of thermal conductivity in the range of 0.030-0.045 W/mK. The specific heat capacity of the fibre material of the first and second insulating layers 2, 4 may be in the range of 840-1000 J/kgK. The density of the fibre material may be in the range of 20-200 kg/m$^3$, preferably in the range of 20-50 kg/m$^3$, most preferably around 35 kg/m$^3$ for glass wool and in the range of 40-60 kg/m$^3$, preferably around 45 kg/m$^3$ for stone wool. By using a fiber material with upper mentioned parameters, a high thermal insulation of the oven cavity 11 may be achieved, wherein the baking oven insulation 1 comprises a low specific heat capacity and/or mass. Thereby, the storage of heat within the baking oven insulation 1 is minimized resulting in a minimal energy loss due to heating up and cooling down the baking oven insulation 1.

The first and second insulating layers 2, 4 may be formed by the same fiber material or different fiber materials. Preferably, the specific heat capacity of the fiber material of the second insulating layer 4 may be higher than the specific heat capacity of the fiber material of the first insulating layer 2. Thereby, the energy losses after heating up the oven cavity (phase of constant or essentially constant temperature within the oven cavity) are reduced. According to another embodiment, the first insulating layer 2 as an inner layer may be constituted by stone wool and the second insulating layer 4 forming the outer layer may be constituted by glass wool, because stone wool has higher temperature stability than glass wool.

The first insulating layer 2 comprises a first thickness $d_1$ and the second insulating layer 4 comprises a second thickness $d_2$. The first thickness $d_1$ may be the same or different to the second thickness $d_2$. According to an aspect of the invention, the first thickness $d_1$ may be smaller than the second thickness $d_2$ ($d_1<d_2$). The ratio between the first and second thicknesses $d_1$, $d_2$ may be in the range between 0.25 and 3, preferably between 0.25 and 1, most preferably between 0.25 and 0.5. The first thickness $d_1$ may be between 5 mm and 20 mm, preferably between 8 mm and 12 mm, specifically 10 mm.

Figure 3:
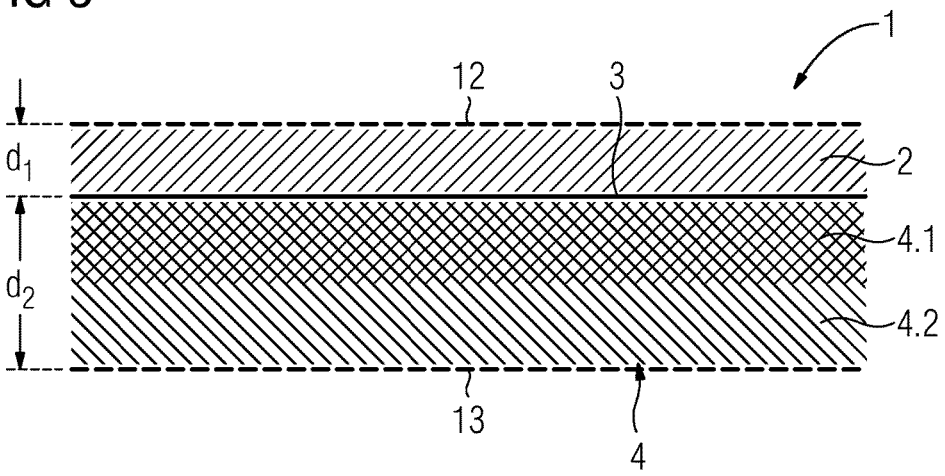
FIG. 3 shows a schematic diagram of a baking oven insulation according to a second embodiment of the invention.

According to a different configuration, the density of the material of the first and/or second isolating layer 2, 4 may be inhomogeneous. FIG. 3 shows a further embodiment of a baking oven insulation 1.

The basic structure of the baking oven insulation 1 is similar to the embodiment of FIG. 2, so, in the following only the differences to the embodiment of FIG. 2 are explained in detail. Apart from that, the description of the embodiment of FIG. 2 may also apply to the embodiment of FIG. 3. The main difference of the baking oven insulation of FIG. 3 is that the second isolating layer 4 comprises two sub-layers 4.1, 4.2, i.e. is formed by a first sub-layer 4.1 and a second sub-layer 4.2. The first sub-layer 4.1 may be immediately adjacent to the metallic sheet material layer 3 and the second sub-layer 4.2 abuts against the first sub-layer 4.1. Said first and second sub-layers 4.1, 4.2 may be interconnected such that the second sub-layer 4.2 is adhered to the first sub-layer 4.1. Said adhesion may be caused by the wadding-like or cotton-like structure of the fibre material of the first and second sub-layers 4.1, 4.2. In order to enhance the interconnection of the first and second sub-layer 4.1, 4.2, said layers may be woven together. Also other additional adhesion-enhancing methods or means, e.g. needling, may be possible.

The first and second sub-layer 4.1, 4.2 may be arranged such that said sub-layers are in parallel or substantially in parallel to one another. In addition, the first and second sub-layer 4.1, 4.2 may comprise the same material or different material. According to one embodiment, the first sub-layer 4.1 may comprise a lower material density than the second sub-layer 4.2. According to another embodiment, the first sub-layer 4.1 may comprise a higher material density than the second sub-layer 4.2. For example, the material densities may differ by at least 10%, preferably by 15%. The thickness of the second insulating layer 4 (sum of the thicknesses of the first and second sub-layer 4.1, 4.2) may be in the range of 1 cm to 2.5 cm, preferably 1.3 cm to 1.8 cm.

Figure 4:
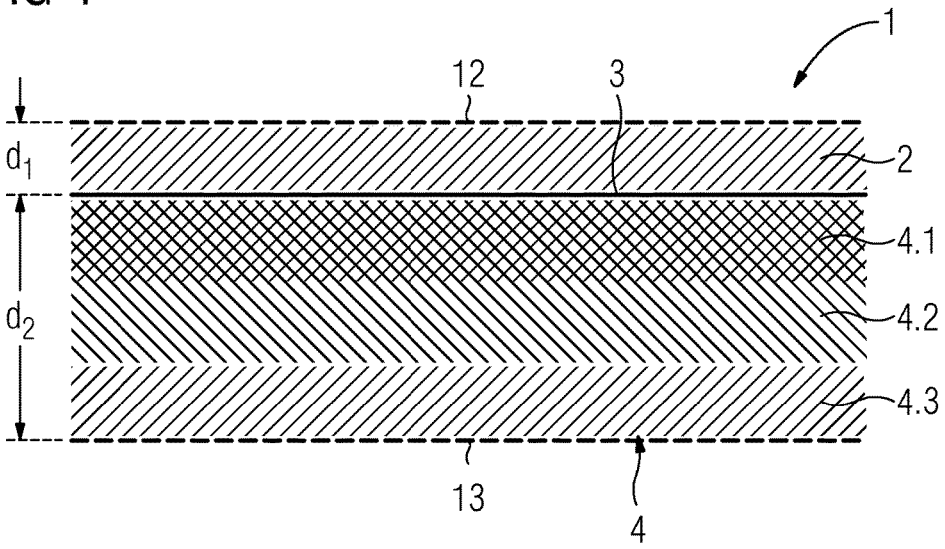
FIG. 4 shows a schematic diagram of a baking oven insulation according to a third embodiment of the invention.

FIG. 4 shows a third embodiment, in which the second isolating layer 4 is constituted by an inhomogeneous material. Specifically, the second isolating layer 4 is formed by a stack of sub-layers 4.1, 4.2, 4.3, namely a first sub-layer 4.1, a second sub-layer 4.2 and a third sub-layer 4.3. The first isolating layer 2 and the metallic sheet material layer 3 are configured according to the features described above. Specifically, the first and third sub-layers 4.1, 4.3 may be formed by a fibre material. The fibre material may be composed as described above. The second sub-layer 4.2 may be embedded within the first and third sub-layers 4.1, 4.3, wherein the first sub-layer 4.1 adjoins to the metallic sheet material layer 3 and the third sub-layer 4.3 forms the outer layer located in proximity to the housing 13.

The second sub-layer 4.2 may be formed by a highly insulating rigid or semi-rigid insulation material, e.g. microporous silica or foam glass. Thereby, the heat insulation effected by the baking oven insulation 1 is optimized.

Preferably, the sum of the thicknesses of the first, second and third sub-layer 4.1, 4.2, 4.3 is $d_2$ and the thickness of the first insulating layer 2 is $d_1$, wherein the first thickness $d_1$ may be smaller than the second thickness $d_2$ ($d_1<d_2$). The ratio between the first and second thicknesses $d_1$, $d_2$ may be in the range between 0.25 and 3, preferably between 0.25 and 1, most preferably between 0.25 and 0.5. The first thickness $d_1$ may be between 5 mm and 15 mm and the thickness $d_2$ may be in the range of 1 cm to 2.5 cm, preferably 1.3-1.8 cm.

The baking oven insulation 1 as described above is advantageous because the heat losses are reduced in comparison to prior art insulations. By using at least two insulating layers consisting of fibre material which are encapsulating a metallic sheet material layer, the baking oven insulation 1 is adapted to encapsulate the oven cavity without any spacings between the cavity wall and the baking oven insulation 1 thereby reducing convective heat flow between the cavity wall and the baking oven insulation 1. Due to the higher insulating effect the baking oven insulation 1 is very suitable if space restrictions prohibit the usage of insulation with high thickness. By using fibre material, the mass, respectively, the heat capacity of the baking oven insulation 1 is reduced. Thus, the energy loss due to heating up and cooling down the baking oven insulation 1 is reduced. In addition, at least the outer layers of the baking oven insulation 1 are flexible thereby enabling an optimal adaption to the cavity wall, respectively, the housing compared to rigid insulation materials.

Above, embodiments of the baking oven insulation according to the present invention as defined in the appended claims have been described. These should be seen as merely non-limiting examples. As understood by a skilled person, many modifications and alternative embodiments are possible within the scope of the invention.

LIST OF REFERENCE NUMERALS

1 baking oven insulation
2 first insulating layer
3 metallic sheet material layer
3 second insulating layer
4.1 first sub-layer
4.2 second sub-layer
4.3 third sub-layer
10 baking oven
11 oven cavity
12 cavity wall
13 housing
$d_1$ thickness of first insulating layer
$d_2$ thickness of second insulating layer

The invention claimed is:

1. Baking oven insulation, comprising at least a first insulating layer composed of a fibre material, a metallic sheet material layer and a second insulating layer at least partially composed of a fibre material, wherein the first and second insulating layers are located at opposite sides of the metallic sheet material layer, wherein the first insulating layer is an inner layer to be arranged immediately at the outer side of a cavity wall of a baking oven and immediately at the inner side of the metallic sheet material layer and the second insulating layer is an outer layer adapted to be spaced from the cavity wall of the baking oven wherein the first insulating layer comprises a thickness d1 which enables the first insulating layer to reduce the heat conduction from the cavity wall to the metallic sheet layer, wherein the second insulating layer comprises a thickness d2, wherein the ratio d1/d2 is in the range between 0.25 and 0.75.

2. Baking oven insulation, comprising at least a first insulating layer composed of a fibre material, a metallic sheet material layer and a second insulating layer at least partially composed of a fibre material, wherein the first and second insulating layers are located at opposite sides of the metallic sheet material layer, wherein the first insulating layer is an inner layer to be arranged immediately at the outer side of a cavity wall of a baking oven and the second insulating layer is an outer layer adapted to be spaced from the cavity wall of the baking oven and wherein the fibre material of the first insulating layer is made of glass wool with a material density between 20-50 kg/m$^3$, or rock wool with a material density between 40-60 kg/m$^3$.

3. Baking oven insulation according to claim 1, wherein the second insulating layer is formed by a stack of insulating sub-layers comprising at least two sub-layers.

4. Baking oven insulation according to claim 1, wherein the fibre material of the first insulating layer is made of glass wool with a material density between 20-50 kg/m$^3$, or rock wool with a material density between 40-60 kg/m$^3$.

5. Baking oven insulation according to claim 1, wherein the metallic sheet material layer is formed by a metallic foil.

6. Baking oven insulation according to claim 1, wherein the first and second insulating layers immediately lie against the metallic sheet material layer.

7. Baking oven insulation according to claim 1, wherein the second insulating layer comprises a thickness d2, wherein the ratio d1/d2 is in the range between 0.25 and 0.75.

8. Baking oven insulation according to claim 1, wherein d1 is in the range of 0.5 cm to 1.5 cm and/or the second insulating layer comprises a thickness d2 in the range of 1 cm to 2.5 cm.

9. Baking oven insulation according to claim 1, wherein the second insulating layer comprises a fibre material with higher material density than the first insulating layer.

10. Baking oven insulation according to claim 1, wherein the fibre material of the first and second insulating layer comprises a coefficient of thermal conductivity in the range of 0.030-0.045 W/mK and/or a specific heat capacity in the range of 840-1000 J/kgK.

11. Baking oven insulation according to claim 1, wherein the second insulating layer comprises a fibre material with higher heat capacity than the first insulating layer.

12. Baking oven insulation according to claim 1, wherein the first and second insulating layers are arranged in parallel or substantially in parallel to one another.

13. Baking oven insulation according to claim 3, wherein the insulating sub-layers are woven together in order to build an integrally formed layer.

14. Baking oven insulation according to claim 3, wherein the material density of a second insulating sub-layer being spaced from the metallic sheet material layer by means of the first insulating sub-layer is at least 10% higher than the material density of the first insulating sub-layer.

15. Baking oven insulation according to claim 1, wherein the second insulating layer is formed by a stack of insulating sub-layers comprising at least three sub-layers.

16. Baking oven insulation according to claim 15, wherein a first sub-layer arranged in direct proximity to the metallic sheet material layer and a third sub-layer being spaced from the first sub-layer by a second sub-layer are composed of a fibre material.

17. Baking oven insulation according to claim 15, wherein a second sub-layer arranged between a first sub-layer and a third sub-layer is formed by a rigid insulation material.

18. Baking oven comprising an oven cavity with a cavity wall, characterized in that, the cavity wall is at least partially covered by a baking oven insulation according to claim 1.

19. Baking oven insulation according to claim 5, said metallic foil being an aluminium foil.

20. Baking oven insulation according to claim 17, said rigid insulation material comprising micro-porous silica or foam glass.

* * * * *